US005536183A

United States Patent [19]

Brandolf

[11] Patent Number: 5,536,183

[45] Date of Patent: Jul. 16, 1996

[54] RE-ENTERABLE STRAIN RELIEF COLLAR EMPLOYING A HEAT RECOVERABLE MEMBER FOR ELECTRICAL CONNECTORS

[75] Inventor: Henry Brandolf, Kernersville, N.C.

[73] Assignee: XL Technologies, Inc., Kernersville, N.C.

[21] Appl. No.: 326,855

[22] Filed: Oct. 21, 1994

[51] Int. Cl.[6] ..... H01R 13/58

[52] U.S. Cl. ..... 439/470; 439/610

[58] Field of Search ..... 439/449, 470–472, 439/610, 932

[56] References Cited

U.S. PATENT DOCUMENTS

| | | | |
|---|---|---|---|
| 3,423,518 | 1/1969 | Weagant . | |
| 3,518,359 | 6/1970 | Trimble et al. . | |
| 3,548,079 | 12/1970 | Jones et al. . | |
| 3,963,295 | 6/1976 | Askman et al. | 439/932 X |
| 4,234,218 | 11/1980 | Rodgers . | |
| 4,565,417 | 1/1986 | Dussel et al. | 439/932 X |
| 4,650,228 | 3/1987 | McMills et al. | 439/932 X |
| 4,834,667 | 5/1989 | Fowler et al. . | |
| 4,924,034 | 5/1990 | Truesdale et al. . | |

FOREIGN PATENT DOCUMENTS

| | | |
|---|---|---|
| 1777915 | 1/1970 | Canada . |
| 20153 | 11/1944 | Finland . |
| 958466 | 3/1950 | France . |
| 2643755 | 8/1990 | France . |
| 184711 | 8/1936 | Germany . |
| 835768 | 2/1952 | Germany . |
| 2540819 | 3/1977 | Germany . |
| 3233939 | 3/1984 | Germany . |
| 2120586 | 5/1990 | Japan . |
| 2224091 | 4/1990 | United Kingdom . |

OTHER PUBLICATIONS

English Abstract page to 2643755.
English Abstract page to 2120586.
English Abstract page to 2540819.
English Abstract page to 3233939.
MIL—HDBK–700(MR); Nov. 1, 1956 (pp. 76–77).
IBM Technical Disclosure Bulletin, (vol. 16, No. 10 dated Mar. 1974).
IBM Technical Disclosure Bulletin, (vol. 16, No. 10 dated Mar. 19, 1974) entitled Annualar Ring Coaxial Termination, R. T. Evans (pp. 3331 and 3332).
MIL–I–81765/1A, Jun. 15, 1987, Military Specification Sheet (Insulating Components, Molded, Electrical, Heat Shrinkable Polyolefin, Crosslinked, Semi–Rigid and Flexible).
MIL–I–81765A(AS) Notice 1, Oct. 29, 1991; Military Specification, Insulating Components, Molded, Electrical, Heat Shrinkable, General Specification For.

*Primary Examiner*—Khiem Nguyen
*Attorney, Agent, or Firm*—Beveridge, DeGrandi, Weilacher & Young

[57] ABSTRACT

A strain relieving connector assembly featuring a circular backshell, a horse collar with a set of standoffs, a split ring clamp, and a heat shrinkable polymeric grommet which is heat shrinkable to radially compress onto the cable and coact with the split ring clamp to provide strain relief for the cable connector interface.

15 Claims, 1 Drawing Sheet

FIG. 1
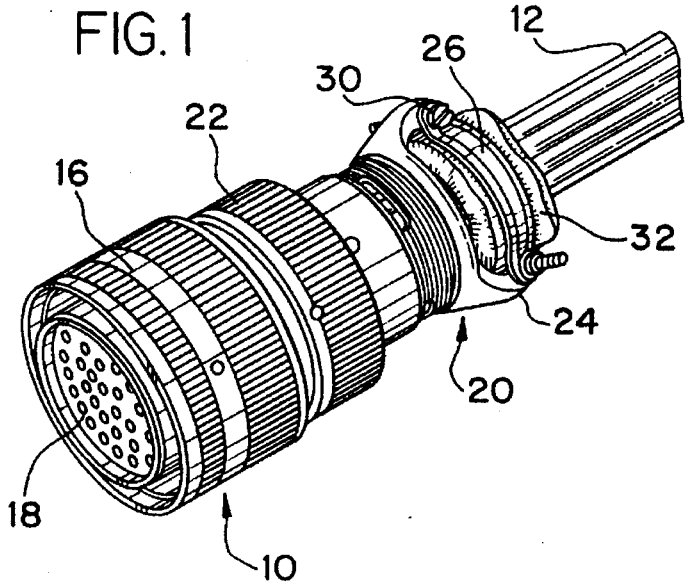
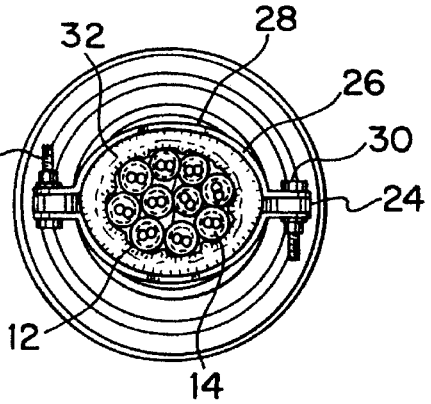
FIG. 2
FIG. 3
PRIOR ART
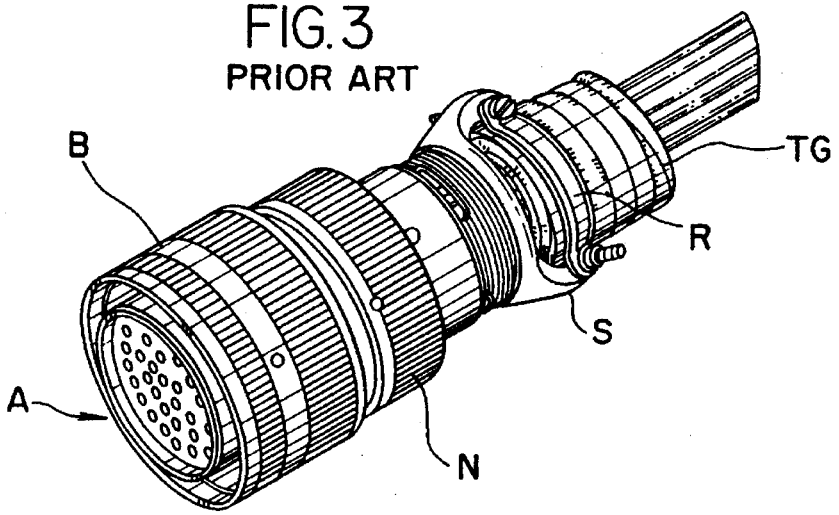

RE-ENTERABLE STRAIN RELIEF COLLAR EMPLOYING A HEAT RECOVERABLE MEMBER FOR ELECTRICAL CONNECTORS

TECHNICAL FIELD

The instant invention relates to a novel, standardized, reusable strain relief assembly for electromagnetic cable connectors and methods for its use. More particularly, the invention combines a heat shrinkable grommet with a horse collar assembly featuring an adjustable, compression split ring for cable-connector strain relief. The invention is particularly suited for use with backshell, terminal-pin connector assemblies.

BACKGROUND OF THE INVENTION

The electrical connector art provides many structures and methodologies to satisfy requirements of specific uses and overcome certain problems associated with establishing secure static connections in particular environments. Generally, it is desirable to stabilize the position of an electromagnetic/electrical connector in order to preserve the integrity of cable/connector interface against vibration and other shock forces. Strain relief assumes heightened importance in vehicular environments due to harsher conditions. For example, aircraft bulkhead feedthrough pin-terminal arrays must be secured against intensified environmental vibration and shock.

Irregularities in installation of electromagnetic conduit connections are of concern in addition to environmental factors. During cable connection installation and maintenance activities, the installer may unintentionally stress a conduit connector interface by using uneven or non-uniform forces. Thus, the cable/connector interface can be stressed during assembly or repair procedures when the conduit is twisted or torqued. In the absence of practiced installation care, the installation process, itself, may impart undesirable torquing force on the conduit which may compromise the electrical connection by damaging the internal cable wires/fibers or cable insulation and corrupting the electrical isolation of cable wires or the pin connections. Consequently, hazardous situations may be created.

In order to protect against unnecessary cable connector damage, strain relief adjuncts have been developed in response to the strain relief problem. Tape wrapping is the most typical strain relief adjunct where the installer wraps insulating tape around the junction of the cable and connector for a select downstream (distal) distance of the cable. The thickness of the tape wrapping governs the degree of enhanced rigidity. Therefore, the tape is wrapped to provide a sufficient number of windings to achieve for the desired strain relief around the cable-connector interface.

The act of winding tape around the cable, itself, generates uneven radial pressures on the internal wire(s)/fibers which can damage fine wires, and fine pin connections and variations inevitably occur during such tape winding. For example, the quantity of tape used and wrapping quality are not necessarily uniform. The number of windings, the winding technique, the skill of the installer, and the conditions at the wrapping situs (a confined or open space), all contribute to differences in the quality and quantity of strain relieving tape wrap. Even non-technical factors such as fatigue of the installer can affect tape wrapping applications and contribute to non-standardization.

The costs associated with non-standardized, custom wrapped, and special tapes used for strain relief—labor, material, and disposal—cannot be ignored. The labor costs associated with tape wrapping, both in original installation and in subsequent repair and modification procedures, may become significant, particularly in confined or dangerous environments. Disposal of used tape may also present an environmental control problem. The tape composition itself may constitute a regulated waste material (halocarbon polymers) or the environment in which the tape has been used may contaminate the discarded tape thereby requiring disposal subject to hazardous waste controls.

As noted, when used in relatively rugged environmental conditions (high vibration environments and the like, e.g. air and space vehicles, military applications, etc.) electrical connector strain relief takes on increased importance which has led to the development of special adjuncts. For example, harness/"horse collar" assembly with a stand-off split ring/tape grommet have been developed for use with backshell connectors used in vehicles. A typical, prior art, split ring/grommet "horse collar" assembly (A), is illustrated in FIG. 3. The assembly (A) includes four components, which may be independent or integrated. The assembly includes: 1) a nut standoff connection (N), generally threaded, to the backshell connector (B); 2) a rearwardly projecting standoff or arm (generally as a pair) (S); 3) a split/hinged clamping ring (R) connected to the rearward end of the standoff and; and 4) a tape grommet (TG) formed from a sufficient number of windings so that the outer diameter of the tape windings matches the inner diameter of the clamping ring. The expression "horse collar" designates the combination of the threaded nut, standoff, and split ring combination.

To establish the strain relieving backshell "horse collar" assembly, the installer connects (screwing or clamping) the nut/standoff member (N) to the backshell, taping the cable exterior in the area underlying the split ring (R) to form a custom tape winding grommet (TG), and screwing/clamping the split ring segments together to radially engage and compress the tape windings onto the cable. A compression fit is achieved by engaging the inner surface of the clamping ring onto the outer surface of the tape windings. By tightening the screws, the spilt ring clamps radially onto the tape grommet to relieve strain and positionally stabilize the cable relative to the backshell and connector.

The resulting assembly reduces cable tension at the connector interface by providing some slack in the cable between the clamping ring and the connector (i.e., coextensive with the standoff). Therefore, the combination of the horse collar, split ring, and tape windings serve to prevent downstream stress on the cable from dislodging the wires from the backshell connector terminal.

Notwithstanding the advantages provided by the above-referenced horse collar, backshell connector/tape assembly, such an arrangement still requires tape winding. Accordingly, it suffers from the shortcomings identified above, with respect to using tape wrapping to provide strain relief.

SUMMARY OF THE INVENTION

It is therefore an object of this invention to overcome the problems of and meet the needs for strain relief associated with electromagnetic conduit connections such as electrical wiring and or optical fiber connectors.

It is an object of this invention to eliminate the need for wrapping tape onto an electromagnetic conduit for strain relief.

It is a further object of this invention to provide a reusable electromagnetic conduit-cable strain relief assembly employable for both original installation or retrofit applications.

Another object of this invention is to provide a standardized "horse collar" type strain relief harness and method for use with backshell type electrical cable connectors which eliminates the need for tape wrapping.

It is a further object of this invention to enhance the usefulness of a clamping split ring collar for strain relief.

Still another object of this invention is to provide a standardized, labor saving, and cost effective cable strain relief assembly.

In accordance with a first aspect which satisfies the foregoing objects, an assembly for strain relief of the interface between an electromagnetic conduit of a selected diameter and a cable connector, comprises:

a) a standoff securing member connectable with the connector;

b) at least one standoff having a predetermined length securable to said standoff securing member;

c) a clamping ring of adjustable inner diameter securable to the standoff and having a select axial length;

d) a clamping ring diameter adjustment member for adjusting the inner diameter of the clamping ring; and e) a dimensionally heat unstable sleeve member having an initial inner diameter greater than that of the conduit, which softens and shrinks about and onto the conduit at a select temperature to a dimensionally heat stable conformation, said sleeve member extending axially with the electromagnetic conduit extending through the sleeve member and said sleeve member being adapted to register with the interior of said clamping ring to impart radially directed hoop stress on the electromagnetic conduit.

In accordance with further aspects of this invention, a reusable strain relief cable connection method is provided for a reusable strain relief assembly including a heat shrinkable sleeve having a select crystalline transition temperature threshold above which dimensional heat instability is induced, a strain relief harness and a clamping ring with an adjustable inner diameter for a cable connector interface between an electrical connector and a cable, the method comprising the steps of:

a) placing the sleeve of heat shrinkable material about the cable;

b) securing the strain relief harness to the to the cable connector and securing the clamping ring about the sleeve;

c) heating the sleeve to a temperature above its crystalline transition temperature to induce softening and shrinkage; and d) permitting the sleeve to shrink and firmly engage the outer surface of the cable and adjusting the clamping ring to radially constrict about the sleeve to develop substantially uniform hoop stress force to positionally stabilize the cable relative to the clamping ring and sleeve.

The invention should become clear to the person having ordinary skill in the art upon review of the drawings and the following detailed description thereof.

BRIEF DESCRIPTION OF THE DRAWINGS

FIG. 1 is a perspective side view of an embodiment of the invention.

FIG. 2 is a cross-sectional illustrated in FIG. 1.

FIG. 3 is a perspective view of a prior art tape grommet horse collar assembly.

ILLUSTRATED MODE FOR CARRYING OUT THE INVENTION

The present invention is a strain relieving split ring type horse collar heat shrinkable grommet assembly generally designated by reference numeral 10. As depicted in FIG. 1, the assembly 10 is associated with an electromagnetic conduit or cable 12 typically found in multiple pin electrical connector applications. As illustrated in FIG. 2, cable 12 houses a bundle of electrical wires 14 terminating with the pin or connector terminal array 18.

The assembly 10 comprises several components including a circular backshell 16, a horse collar 20, a set of standoffs 24, a split ring clamp 26, and a heat shrinkable polymeric grommet 32. The circular backshell 16 is composed of a nonferrous material, e.g. aluminum or molded polymer resin. The particular composition of the material is not important so long as it is substantially non-electrically conductive and has sufficient strength and rigidity to maintain connector integrity. The backshell 16 incorporates a horse collar securing feature, typically tapped threading to permit a horse collar 20 to be screwed onto it. Once seated on the backshell 16, the horse collar 20 extends rearwardly from the backshell 16 for a selected distance and coaxially overlies the cable 12.

The horse collar 20, generally, but not necessarily, is composed of the same material as the backshell 16. The horse collar 20 includes a threaded ring 22, a pair of matching standoffs 24, and an adjustable diameter compression split ring 26 for surrounding the cable 12 at the end of the standoff 24.

The connector ring 22 has a diameter somewhat greater than that of the threaded blind side of the backshell 16 and may exceed the diameter of the backshell pin terminal array. The threaded connector ring 22 is sized to mate with the complementary annular threads formed in the outer surface of backshell 16. As an alternative to the complementary threads, the horse collar 20 may be affixed to the backshell 16 by other suitable securing means such as adhesive, compression fit, etc.

The two standoffs 24 project rearwardly from the connector ring 22 and are circumferentially opposed (180°). The length of the standoffs 24 is generally two to four times the axial length of the split ring 26 but may be shorter or longer as needed. The rearward end (posterior) of the standoff 24, that opposite the ring 22, features a flattened lug with a hole for mounting of the split ring 26. Each of the semi-cylindrical, split ring halves 28 are mounted to the flattened attachment lug. The lug hole may be tapped or untapped and is adapted to receive a compression adjustment screw 30 to interlock the split ring halves 28 to the standoff 24. By tightening the compression adjustment screws 30, the diameter of the split ring 26 can be adjusted to cause the clamping split ring 26 to be radially tightened or loosened relative to the cable 12, as required. An alternative construction of split ring 26 is where it has a hinge type connection associated with one of the standoffs.

The assembly 10 features the heat shrinkable grommet 32. The heat shrinkable grommet 32 is a tubular sleeve of dimensionally heat unstable polymeric material selected to have physical properties corresponding with the requirements of a particular application or particular need. The polymeric material forming heat shrinkable sleeve 32 has a crystalline transition temperature at which point the material looses its crystalline integrity. Hence, if prestressed and in a heat dimensionally unstable configuration (heat shrinkable), once the crystalline transition temperature is exceeded, the material "recovers" (shrinks) to a more heat stable configuration. Thus, a new sleeve grommet 32 recovers to its heat dimensionally stable dimensions, e.g. shrinks, at its crystalline transition temperature. Such materials include high and low density polyethylenes, EVA (ethyl vinyl acetate), Neoprene, Hypolen or Viton (available from DuPont), and even silicone.

Correspondingly, once the crystalline transition temperature is achieved, the sleeve material softens and exhibits significantly enhanced pliability and flexibility. Accordingly, where the sleeve grommet 32 was previously installed—subject to heat recovery—upon reheating and release of radial compression by the split ring 26, the sleeve material will soften, become more pliable and permit manipulation of wires in the underlying cable 12. Upon cooling, the sleeve grommet 32 resumes relatively harder and more rigid sub-transition temperature physical properties. Therefore, the compression screws 30 must be tightened before the sleeve grommet cools to a temperature below its crystalline transition temperature.

In order to satisfy more stringent application requirements, it is preferred that the polymeric resin forming the grommet-sleeve 32 meet the parameters of ASTM D 2671 and, even more preferably, conform to Military Specification MIL-I-81765A (issued Jun. 15, 1987 and validated Oct. 29, 1991) and (MIL-I-81765/1A) for semi-rigid or flexible insulating heat shrinkable polyolefin components. Those specifications refer specifically to insulating, molded, heat shrinkable strain relief boots.

In order to facilitate initial installations, it is preferred that the heat shrinkable grommet sleeve 32 has a diameter substantially greater than that of cable 12 and an axial length substantially longer than the axial length of the split ring 26. More specifically, it is preferred that the grommet sleeve 32 has a diameter at least double that of the cable and an axial length of about twice that of the split ring 26. The significant capacity for heat shrinkage of sleeve-grommet 32 is desirable for two reasons.

In the case of the initial installation, where the sleeve has a diameter large enough to slide over the backshell connector 16 and/or horse collar 20, the installer can slide the sleeve over a pre-assembled strain relieving horse collar assembly. The installer then positions the sleeve-grommet 32 over the cable 12 and under the split ring 26 prior to clamping and adjusts the inner diameter of the split ring 26 to correspond to the outer annulus defined by the grommet-sleeve 32 overlying the cable 12.

The second advantage of a high shrink capacity sleeve is that the sleeve-grommet 32 radially compresses and securely binds around the cable 12. To meet these objectives generally, the ratio of heat recoverability of the sleeve-grommet 32 is from between 1:2 to 1:8.

The final physical parameter of the sleeve grommet 32 concerns thickness. In order to prevent tearing, puncture, or abrasion damage in use, the sleeve grommet 32 must have a thickness sufficient to provide substantially uniform hoop stress on the underlying cable 12 during tightening of the clamping split ring 26 and to preserve structural integrity once installed. In short, the sleeve grommet thickness must accommodate radial compression of the split ring onto it and to permit the spilt ring to bite uniformly into it as it cools and hardens from a heated, softened condition. Once set, the sleeve must be able to provide the required strain relief and to coact with the ring without damaging the underlying cable.

The particular parameters required of the heat shrinkable grommet 32 in the strain reducing assembly of this invention is application specific. However, the invention provides many advantages not available in the prior art and may be applicable to provide strain relief in other connector disciplines other than multi-wire electrical cabling such as optical fiber cabling. In the case of optical fiber cabling connections, the advantages provided by the invention should be apparent, particularly in the context of providing generally uniform radial compression and avoiding damage to the sheathed optical fibers proximate to the connector interface. Consequently, this invention permits the use of a strain relieving horse collar assembly engineered to meet the parameters required for optical fiber applications.

In another variation, this invention can be combined with other features, for example, to provide for uniform sleeve heating. In such a variation, well known, resistive heating elements could be incorporated into the grommet sleeve for substantially uniform heat distribution throughout the sleeve. Preferably, those elements, themselves, should exhibit heat recoverability properties (e.g. martinsite metals).

Given the foregoing, variations and modifications to the invention should now be apparent to a person having ordinary skill in the art. These variations and modifications are intended to fall within the scope and spirit of the invention as defined by the claims following the description of industrial applicability.

Industrial Applicability

This invention has great utility as an electromagnetic cable strain relief assembly. The reusable strain relief horse collar assembly of this invention is particularly suitable for strain relief in conjunction with electrical cabling—backshell connections employed in dynamic environments such as air and space craft. The invention is also applicable for use in strain relief applications other electromagnetic conduits, e.g., optical fibers. This invention reduces labor and environmental waste by providing a standardized, reusable strain relief assembly.

What is claimed is:

1. An assembly for strain relief of the interface between an electromagnetic conduit of a selected diameter and a conduit connector, comprising:

a) a standoff securing member connectable with the conduit connector;

b) at least one strain relief standoff having a predetermined length securable to said standoff securing member;

c) a clamping ring having an adjustable inner diameter which clamping ring is securable to the standoff and has a select axial length;

d) a clamping ring diameter adjustment member for adjusting the inner diameter of the clamping ring; and e) a dimensionally heat unstable removable and reusable sleeve member having an initial inner diameter greater than that of the conduit connector and clamping ring, which at a select temperature softens and shrinks about and onto the conduit to a dimensionally heat stable conformation, said sleeve member extending axially with the electromagnetic conduit extending through the sleeve member and said sleeve member having a shrunken diameter smaller than the clamping ring and being adapted to register with the interior of said clamping ring to impart radially directed hoop stress on the electromagnetic conduit.

2. The strain relief assembly according to claim 1 where the conduit is a multi-wire electrical cable and the sleeve is sufficiently softenable at temperatures exceeding its crystalline transition temperature to permit manipulation of a select wire within the cable.

3. The strain relief assembly according to claim 2 where the sleeve has an axial length about twice the axial length of the split ring.

4. The strain relief assembly according to claim 3 where the sleeve has a capacity for recovery to its dimensionally heat stable diameter recover to at least about half of its dimensionally heat unstable diameter.

5. The strain relief assembly according to claim 3 where the sleeve is tubular and possesses a degree of dimensional heat recovery of the sleeve diameter in the range from 1 to 8.

6. The strain relief assembly according to claim 3 where the sleeve has an original diameter greater than the diameter of the cable connector and can shrink to about one-sixth its original diameter.

7. The strain relief assembly according to claim 5 where said standoff securing member is a collar and the connector is a threaded backshell and the standoff securing member is threaded to mate with the backshell.

8. An improved electromagnetic conduit connection horse collar strain relief assembly for use with a backshell type connector where the horse collar projects a select distance from the backshell and surrounds a conduit with a split ring clamp having a selected axial length and a member for adjusting the split ring inner diameter the improvement comprising a polymeric heat shrinkable sleeve being softenable at a crystalline transition temperature, having an axial length greater than that of the split ring, an initial inner diameter greater than that of the conduit and the backshell connector, and a heat dimensionally stable diameter less than that of the conduit, whereupon reaching the crystalline transition temperature, said heat shrinkable sleeve softens and shrinks about the conduit radially compressing about the conduit and permitting said split ring to engage and impress about the softened sleeve to secure the conduit, heat shrinkable sleeve, and split ring to establish an integrated strain relieving assembly.

9. A method for establishing a reusable strain relief assembly including a heat shrinkable sleeve having a select crystalline transition temperature threshold above which dimensional heat instability is induced, a strain relief harness and a clamping ring with an adjustable inner diameter for a cable connector interface between a electrical connector and a cable, comprising the steps of:

a) assembling the electrical connector with the cable;

b) sliding the sleeve of heat shrinkable material over the assembled connector and about the cable;

c) securing the strain relief harness to the electrical connector and positioning the clamping ring about the sleeve;

d) heating the sleeve to a temperature above its crystalline transition temperature to induce softening and shrinkage;

e) permitting the sleeve to shrink and firmly engage the outer surface of the cable; and f) adjusting the clamping ring to radially constrict about the sleeve to develop substantially uniform hoop stress force to positionally stabilize the cable relative to the clamping ring and sleeve.

10. A method according to claim 9 further comprising the steps of:

increasing the inner diameter of the clamping ring and loosening the clamping ring from the sleeve, reheating the sleeve to a temperature above its crystalline transition temperature, manipulating the cable as required, reheating the sleeve to a temperature above its crystalline transition temperature, and re-tightening the clamping ring about the sleeve and cable to provide cable strain relief.

11. A method according to claim 10 where the sleeve is capable of shrinking to at least half of its heat dimensionally unstable diameter.

12. A method according to claim 10 where the heat dimensionally stable diameter of the sleeve is in the range of 2 to 8 times less than the unshrunken heat dimensionally unstable diameter.

13. A method for establishing a strain relieving backshell-horse collar assembly including a heat shrinkable sleeve having a select crystalline transition temperature threshold above which dimensional heat instability is induced, a horse collar harness featuring a strain relief harness and a clamping ring with an adjustable inner diameter for a cable connector interface between an electrical connector and a cable, comprising the steps of:

a) assembling the horse collar to the electrical connector on the cable and positioning the strain relief harness about the cable;

b) translating the sleeve of heat shrinkable material over the assembled horse collar and electrical connector to a position about the cable proximate to the harness and underlying the clamping ring;

c) heating the sleeve to a temperature above its crystalline transition temperature to induce softening and shrinkage; and d) permitting the sleeve to shrink and firmly engage the outer surface of the cable and adjusting the clamping ring to radially constrict about the sleeve to develop substantially uniform hoop stress force to positionally stabilize the cable relative to the clamping ring and sleeve.

14. A process for making the strain relief assembly of claim 1.

15. A method of relieving strain on a cable using the strain relief assembly of claim 1.

* * * * *